US009630238B2

(12) United States Patent
Higai et al.

(10) Patent No.: US 9,630,238 B2
(45) Date of Patent: Apr. 25, 2017

(54) METHOD AND APPARATUS THAT FORMS A CLOSED CROSS-SECTIONAL STRUCTURE

(71) Applicant: JFE Steel Corporation, Tokyo (JP)

(72) Inventors: Kazuhiko Higai, Chiba (JP); Toyohisa Shinmiya, Fukuyama (JP); Yuji Yamasaki, Fukuyama (JP)

(73) Assignee: JFE Steel Corporation (JP)

( * ) Notice: Subject to any disclaimer, the term of this patent is extended or adjusted under 35 U.S.C. 154(b) by 120 days.

(21) Appl. No.: 14/403,379

(22) PCT Filed: May 23, 2013

(86) PCT No.: PCT/JP2013/003284

§ 371 (c)(1),
(2) Date: Nov. 24, 2014

(87) PCT Pub. No.: WO2013/179617

PCT Pub. Date: Dec. 5, 2013

(65) Prior Publication Data

US 2015/0114070 A1 Apr. 30, 2015

(30) Foreign Application Priority Data

May 28, 2012 (JP) ..... 2012-120527

(51) Int. Cl.
*B21J 5/02* (2006.01)
*B21D 5/04* (2006.01)
(Continued)

(52) U.S. Cl.
CPC ..... *B21J 5/025* (2013.01); *B21D 5/01* (2013.01); *B21D 5/04* (2013.01); *B21D 26/033* (2013.01);
(Continued)

(58) Field of Classification Search
CPC . B21D 5/01; B21D 5/015; B21D 5/04; B21D 5/10; B21D 5/16; B21D 17/02;
(Continued)

(56) References Cited

U.S. PATENT DOCUMENTS 6,601,427 B2 * 8/2003 Kondou ..... B21C 37/104 72/368
2004/0035166 A1 * 2/2004 Maeda ..... B21D 5/015 72/48
(Continued)

FOREIGN PATENT DOCUMENTS

JP 57-165120 10/1982
JP 10-58040 3/1998
(Continued)

OTHER PUBLICATIONS

Machine Tranlsation of Description section of JP2006116552 provided by EPO website (Espacenet).*

*Primary Examiner* — Peter DungBa Vo
*Assistant Examiner* — Joshua D Anderson
(74) *Attorney, Agent, or Firm* — DLA Piper LLP (US)

(57) ABSTRACT

A workpiece is formed into a curved shape that has curvatures in the longitudinal and width directions required for a final closed cross-sectional shape. The formed workpiece is bent in a direction that left and right side wall portions approach each other by clamping the bottom portions between a punch and pad in a plate-thickness direction. A pair of flange portions are butted against each other while the formed bottom portions of the workpiece are placed on a pad; and a die cavity having the same shape as the final closed cross-sectional shape is defined between a support surface of the pad supporting the bottom portion and pressing surfaces of a pair of pressure cams pressing the left and right side wall portions. Then, the pair of flange portions are
(Continued)

depressed toward the cavity using depressing portions of a second punch disposed above the pair of flange portions.

3 Claims, 6 Drawing Sheets

(51) Int. Cl.

| | |
|---|---|
| ***B21J 13/02*** | (2006.01) |
| ***B21D 39/02*** | (2006.01) |
| ***B21D 47/01*** | (2006.01) |
| ***B21D 26/033*** | (2011.01) |
| *B21D 5/01* | (2006.01) |

(52) U.S. Cl.
CPC ..... *B21D 39/02* (2013.01); *B21D 47/01* (2013.01); *B21J 13/02* (2013.01); *B21D 5/015* (2013.01)

(58) Field of Classification Search
CPC .... B21D 19/08; B21D 19/082; B21D 26/033; B21D 35/002; B21D 39/02; B21D 39/026; B21D 39/028; B21D 47/01; B21D 47/06; B21D 53/88; B21J 1/04; B21J 5/025; Y10T 29/49915; Y10T 29/49922; Y10T 29/49936; B21C 37/06; B21C 37/08; B21C 37/0803; B21C 37/0815; B21C 37/15; B21C 37/155
USPC ..... 72/48, 51, 352, 353.2, 353.4, 353.6, 72/354.2, 356, 357, 367.1, 368, 379.2, 72/379.6; 138/170, 171; 29/509, 513, 29/524
See application file for complete search history.

(56) References Cited

U.S. PATENT DOCUMENTS

| | | | | |
|---|---|---|---|---|
| 2010/0193064 | A1* | 8/2010 | Takada | B21C 37/0803 138/156 |
| 2010/0218375 | A1* | 9/2010 | Saito | B21D 5/015 29/897.2 |
| 2011/0174409 | A1 | 7/2011 | Higai et al. | |
| 2011/0174868 | A1* | 7/2011 | Higai | B21D 5/10 228/136 |

FOREIGN PATENT DOCUMENTS

| | | |
|---|---|---|
| JP | 2006-116552 | 5/2006 |
| JP | 2010-75945 | 4/2010 |
| JP | 2013-049077 | 3/2013 |

* cited by examiner

METHOD AND APPARATUS THAT FORMS A CLOSED CROSS-SECTIONAL STRUCTURE

TECHNICAL FIELD

This disclosure relates to a method and an apparatus that forms a plate-shaped workpiece into a closed cross-sectional structure.

BACKGROUND

A method is described in Japanese Unexamined Patent Application Publication No. 2006-116552 as a method of manufacturing a part having a closed cross section.

In Japanese Unexamined Patent Application Publication No. 2006-116552, the following steps are successively performed: a step of making a semifinished part by press-forming a metal plate so that a pair of half portions of a closed cross-sectional structure extend upwardly from ends of a connecting part having a flat cross section; a step of making the half portions of the closed cross-sectional structure extend further upwardly while forming the connecting part into a bent part having a V-shaped cross section by pressing the connecting part from the inside by using a flat punch inserted into a space between the pair of half portions of the closed cross-sectional structure; and a step of causing outer ends of the half portions of the closed cross-sectional structure to be butted against each other and welding the outer ends after withdrawing the flat punch from the space between the pair of half portions of the closed cross-sectional structure.

Japanese Unexamined Patent Application Publication No. 2006-116552 discloses methods of forming structures having closed cross sections of circular, rectangular, pentagonal, and polygonal shape. With that method, a flat punch having a protrusion at an end thereof is inserted into a space between the pair of half portions of a closed cross-sectional structure, and the half portions of the closed cross-section structure are made to extend further upwardly while forming the connecting part into a bent part having a V-shaped cross section by pressing the connecting part from the inside using the flat punch.

Thus, it is necessary to form the bent part having a V-shaped cross section when making the half portions of the closed cross-sectional structure extend upwardly. Because the V-shaped bent part is formed by bending the connecting part into a shape having a comparatively small radius (radius of curvature), a crack may be generated at the V-shaped bent part when a material having a low ductility such as a high-tensile strength steel, is used. Moreover, a crack not visible to the naked eye is likely to be generated and a fracture is likely to occur.

Therefore, the method described in Japanese Unexamined Patent Application Publication No. 2006-116552 has a problem related to formability when the method is used to form a structural part of an automobile such as a front side member. If the end of the V-shaped bent had a round shape, the half portions of the closed cross-sectional structure would extend upwardly to a smaller degree, and therefore it would become difficult to perform welding in the next step.

Moreover, to form a closed cross-sectional structure having curvatures in three-dimensional directions by using the method described in Japanese Unexamined Patent Application Publication No. 2006-116552, it is necessary to form the three-dimensionally curved shapes in the pair of half portions of the closed cross-sectional structure and to form flange portions at ends of the pair of half portions of the closed cross-sectional structure in the width direction with high precision. Accordingly, the method has a problem related to the production cost.

It could therefore be helpful to provide a method and an apparatus that forms a closed cross-sectional structure having a three-dimensionally curved shape. By using the method and the apparatus, structures used as structural parts of an automobile or the like can be formed with high precision and can be manufactured at a reduced production cost.

SUMMARY

We thus provide:

A method of forming a plate-shaped workpiece into a closed cross-sectional structure, the structure including a bottom portion formed in a central part thereof in a width direction, left and right side wall portions located on both sides of the bottom portion in the width direction, and a pair of flange portions formed at ends of the left and right side wall portions in the width direction.

The method includes:

a first step of press-forming the workpiece into a curved shape that has curvatures in a longitudinal direction and in the width direction required for a final closed cross-sectional shape;

a second step of bending the workpiece, which has been formed in the first step, so that the left and right side wall portions face each other by clamping the bottom portion between a first punch and a pad in a plate-thickness direction; and a third step of pushing a pair of pressure cams inwardly, while the bottom portion of the workpiece formed in the second step is placed on the pad, to move the left and right side wall portions closer to each other so that the pair of flange portions are butted against each other and to define a die cavity having the same shape as the final closed cross-sectional shape with a support surface of the pad supporting the bottom portion and pressing surfaces of the pair of pressure cams pressing the left and right side wall portions, and of pressing the bottom portion and the left and right side wall portions against the support surface and the pressing surfaces that forms the die cavity by depressing the pair of flange portions toward the cavity using a depressing portion of a second punch disposed above the pair of flange portions.

[2] In the method of forming the closed cross-sectional structure described in [1], the final closed cross-sectional shape is a shape in which the bottom portion and the left and right side wall portions have curvatures.

[3] An apparatus that forms a plate-shaped workpiece into a closed cross-sectional structure, the structure including a bottom portion formed in a central part thereof in a width direction, left and right side wall portions located on both sides of the bottom portion in the width direction, and a pair of flange portions formed at ends of the left and right side wall portions in the width direction. The apparatus includes:

a pressing die including an upper die and a lower die for press-forming the workpiece into a curved shape that has curvatures in a longitudinal direction and in the width direction required for a final closed cross-sectional shape;

a bending die for bending the workpiece, which has been formed using the pressing die, so that the left and right side wall portions face each other by clamping the bottom portion between a first punch and a pad in a plate-thickness direction; and a final-closed-cross-section bending die including a pair of pressure cams for moving the left and right side wall portions closer to each other and a second punch disposed above the pair of flange portions, the second punch including a depressing portion for depressing the pair of flange portions that are butted against each other, the final-closed-cross-section bending die defining a die cavity having the same shape as the final closed cross-sectional shape with a support surface of the pad supporting the bottom portion and pressing surfaces of the pair of pressure cams pressing the left and right side wall portions, the depressing portion of the second punch pressing the bottom portion and the left and right side wall portions against the support surface and the pressing surfaces by depressing the pair of flange portions that are butted against each other toward the cavity.

The method of forming a closed cross-sectional structure in [1], includes the third step of pushing a pair of pressure cams inwardly, while the bottom portion of the workpiece formed in the second step is placed on the pad, to move the left and right side wall portions closer to each other so that the pair of flange portions are butted against each other and to define a die cavity having the same shape as the final closed cross-sectional shape between a support surface of the pad supporting the bottom portion and pressing surfaces of the pair of pressure cams pressing the left and right side wall portions, and of pressing the bottom portion and the left and right side wall portions against the support surface and the pressing surfaces that form the die cavity by depressing the pair of flange portions toward the cavity using a depressing portion of a second punch disposed above the pair of flange portions. Therefore, a closed cross-sectional structure can be easily formed with high precision, and the closed cross-sectional structure can be formed at a reduced cost.

With the method of forming the closed cross-sectional structure described in [2], a closed cross-sectional structure having a predetermined three-dimensionally curved shape can be formed with high precision. With the apparatus for forming a closed cross-sectional structure described in [3], a closed cross-sectional structure having a predetermined shape can be easily formed, and the production cost can be considerably reduced.

REFERENCE SIGNS LIST

Figure 1:
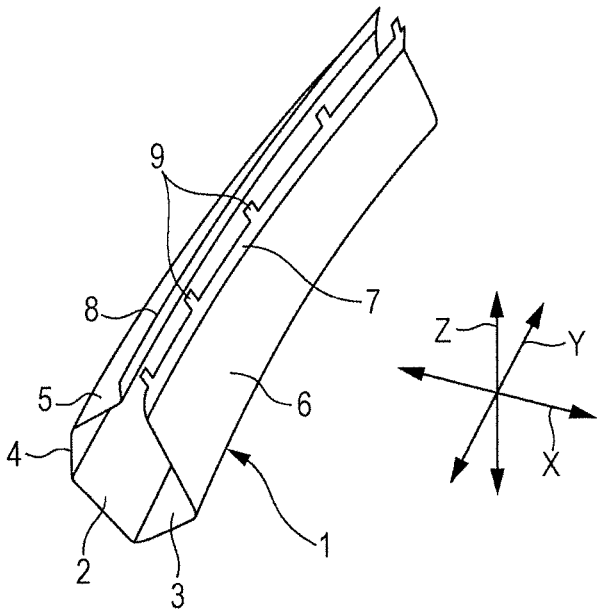
FIG. 1 is a perspective view of a closed cross-sectional structure formed by using our forming method.

1 workpiece
2, 3 bottom portion
4, 5 left side wall portion
6 right side wall portion
7, 8 flange portion
9 hemming prong
10 upper die
11 lower die
15 first punch
16 pad
21 second punch
23, 24 pressure cam
25 hydraulic actuator
26 cam driving mechanism
27 slit clearance
28 insert guide surface
30 hemming portion
31 depressing portion
32 protrusion
33, 34 flange clamping portion
B1 to B6 bend line

DETAILED DESCRIPTION

Hereinafter, examples will be described with reference to the drawings.

FIG. 1 illustrates the shape of a workpiece 1 in the process of being formed into a closed cross-sectional structure having an irregularly pentagonal cross-sectional shape. The workpiece 1 includes bottom portions 2 and 3, which form two sides of the irregularly pentagonal shape; left side wall portions 4 and 5, which form two sides of the irregularly pentagonal shape; a right side wall portion 6, which forms the remaining side of the irregularly pentagonal shape; and a pair of flange portions 7 and 8. The flange portions 7 and 8 are formed to be continuous with the right side wall portion 6 and the left side wall portion 5 and are butted against each other. The workpiece 1 extends in the longitudinal direction.

A plurality of hemming prongs 9 are arranged along an edge of the flange portion 7 at predetermined intervals in the longitudinal direction.

The bottom portions 2 and 3, the left side wall portions 4 and 5, the right side wall portion 6, and the flange portions 7 and 8 are each formed to have curvatures in the Y-axis direction, in the X-axis direction, and in the Z-axis direction (to have a three-dimensionally curved shape) in a three-dimensional coordinate system. In this coordinate system, the Y-axis extends in the longitudinal direction, the X-axis extends in the width direction, and the Z-axis extends in a direction perpendicular to a surface including the Y-axis and the X-axis.

Structure of Apparatus

An apparatus that forms a closed cross-sectional structure includes a workpiece pressing die, a bending die, and a hemming press apparatus (final-closed-cross-section bending die).

Figure 2:
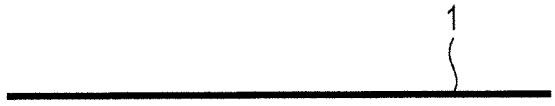
FIGS. 2(*a*)-2(*c*) schematically illustrate the process of a first step and the devices used in the first step.
Figure 2:
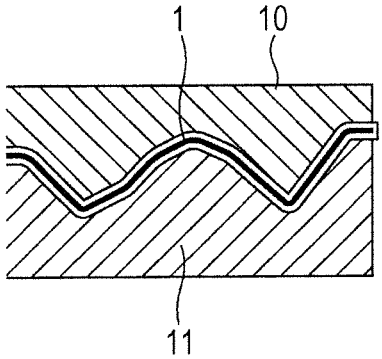
Figure 2:
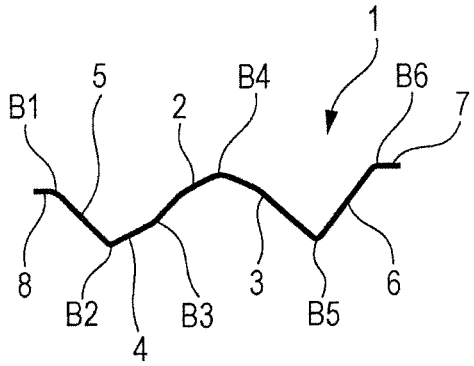

FIG. 2(*b*) illustrates the workpiece pressing die, which includes an upper die 10 and a lower die 11.

A press-forming surface of the upper die 10, which faces in a downward direction, and a press-forming surface of the lower die 11, which faces in an upward direction, have shapes that correspond to each other. A press-forming operation is performed by placing the plate-shaped workpiece 1 shown in FIG. 2(*a*) between the press-forming surface of the upper die 10 and the press-forming surface of the lower die 11 and by pressing the upper die 10 against the lower die 11.

As illustrated in FIG. 2(*c*), the workpiece 1, which has been press-formed using the workpiece pressing die, has the bottom portions 2 and 3 located at substantially a central part thereof in a width direction, the left side wall portions 4 and 5 located on a side of the bottom portion 2 in the width direction, the right side wall portion 6 located on a side of the bottom portion 3 in the width direction, the flange portion 8 located at an end of the left side wall portion 5 in the width direction, and the flange portion 7 (which has the hemming prongs 9) located at an end of the right side wall portion 6 side in the width direction. Line-length adjustment is performed by forming bend lines B1 to B6 extending in the longitudinal direction along boundaries between the portions 2 to 8.

Figure 3:
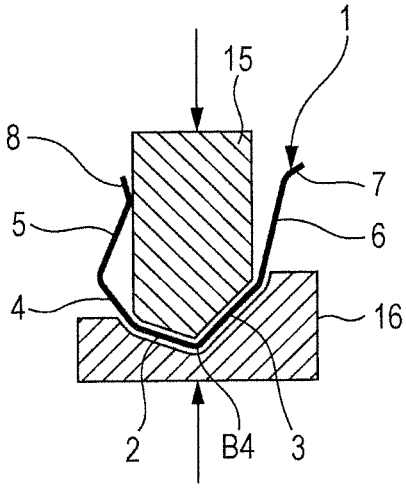
FIG. 3 schematically illustrates the process of a second step and the devices used in the second step.

FIG. 3 illustrates the bending die which includes a first punch 15 and a pad 16.

The cross-sectional shape of a pressing portion of the first punch 15, that is, the cross-sectional shape of a lower end portion, is the same as that of the bottom portions 2 and 3 of the closed cross-sectional structure.

The pad 16 faces the first punch 15 in the vertical direction. An upper surface of the pad 16 has the same shape as the cross-sectional shape of a lower end portion of the first punch 15. The bottom portions 2 and 3 of the workpiece 1, which has been press-formed using the workpiece pressing die, are clamped between the first punch 15 and the pad 16 in the plate-thickness direction.

Figure 4:
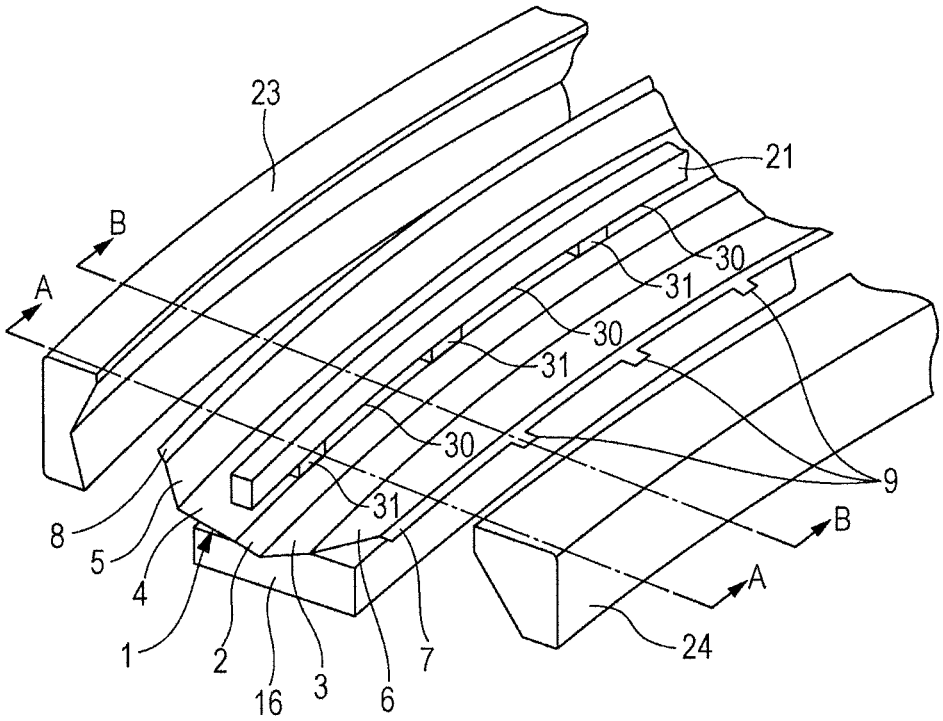
FIG. 4 schematically illustrates the process of a third step and the devices used in the third step.
Figure 5:
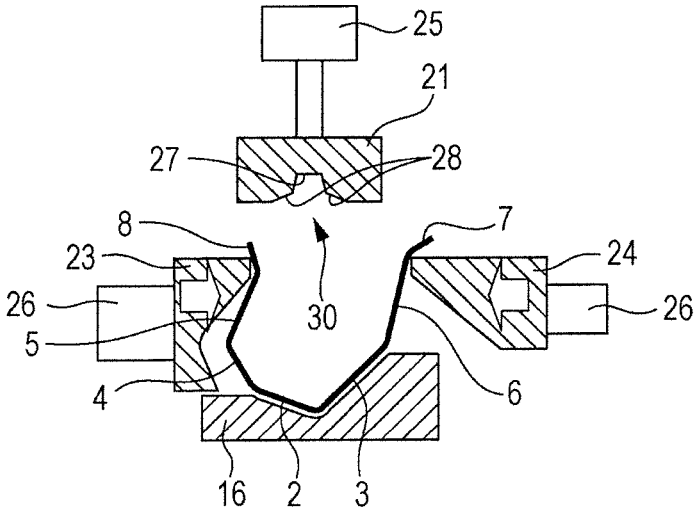
FIGS. 5(*a*)-(*c*) show schematic views seen in the direction of arrows B-B of FIG. 4, illustrating a hemming operation performed in the third step.
Figure 5:
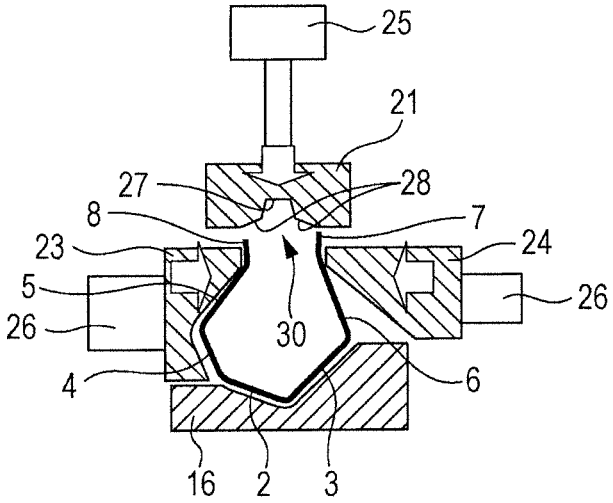
Figure 5:
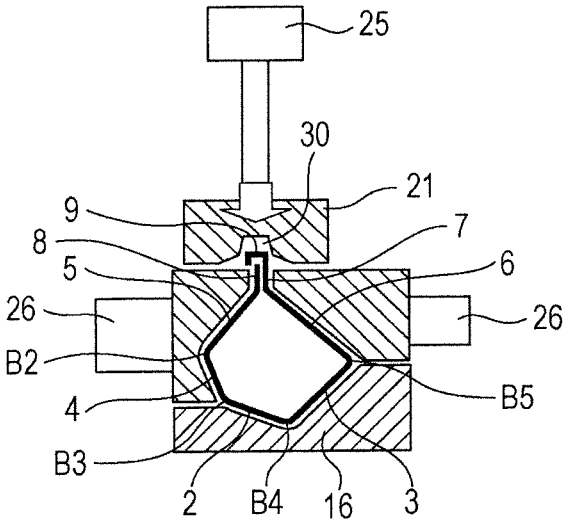
Figure 6:
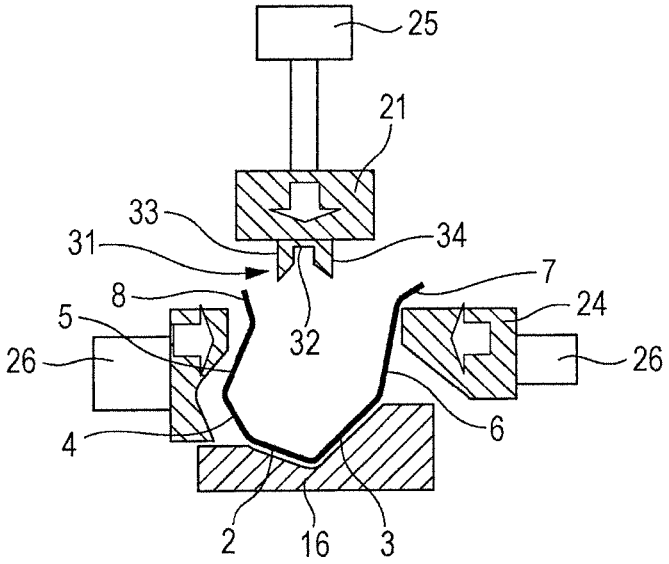
FIGS. 6(*a*)-(*c*) show schematic views seen in the direction of arrows A-A in FIG. 4, illustrating an operation of depressing flange portions performed in the third step.
Figure 6:
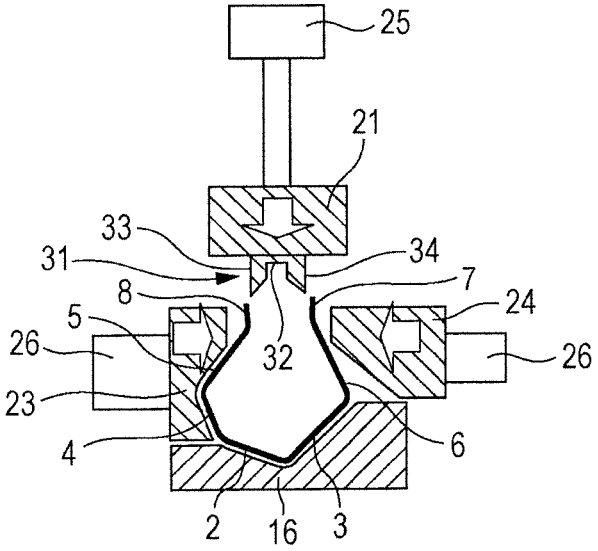
Figure 6:
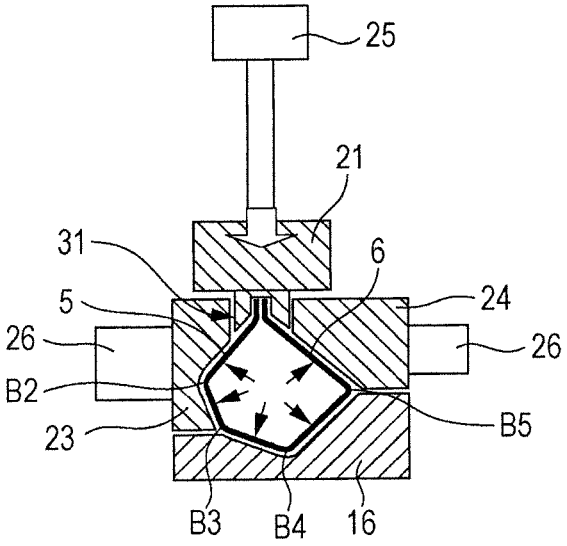

Moreover, FIGS. 4 to 6 illustrate the hemming press apparatus, which includes the pad 16 of the aforementioned bending die, a second punch 21 disposed above the pad 16, a pair of pressure cams 23 and 24 disposed away from each other in the width direction of the pad 16.

The second punch 21 is a long member having substantially the same length as that of the workpiece 1 in the longitudinal direction. As illustrated in FIG. 5(*a*), the second punch 21 is moved by a hydraulic actuator 25 in the vertical direction. As illustrated in FIG. 5(*a*), the pair of pressure cams 23 and 24 are each a long member having substantially the same length as that of the workpiece 1 in the longitudinal direction. Cam driving mechanisms 26, which move in accordance with the operation of the hydraulic actuator 25, connects to the pair of pressure cams 23 and 24. The cam driving mechanisms 26 move the pair of pressure cams 23 and 24 to pressing positions or to standby positions located away from each other.

A pressing surface of the pressure cam 23 has a three-dimensionally curved shape the same as that of the left side wall portions 4 and 5 of the closed cross-sectional structure.

A pressing surface of the pressure cam 24 has a three-dimensionally curved shape the same as that of the right side wall portion 6 of the closed cross-sectional structure.

The second punch 21 includes hemming portions 30 and depressing portions 31.

As illustrated in FIG. 5(*a*), each of the hemming portions 30 has a slit clearance 27 and insert guide surfaces 28. The slit clearance 27 is formed at the center of a lower end surface of the second punch 21 in the width direction, and the insert guide surfaces 28 are formed on peripheries of an opening of the slit clearance 27.

As illustrated in FIG. 6(*a*), each of the depressing portions 31 includes a protrusion 32 protruding downwardly from the lower end surface of the second punch 21, and a pair of flange clamping portions 33 and 34 protruding downwardly from edges of the protrusion 32 to extend parallel to each other.

Method of Forming a Closed Cross-Sectional Structure

Next, a method of forming a closed cross-sectional structure by using the workpiece pressing die, the bending die, and the hemming press apparatus having the aforementioned constructions will be described.

First Step

As illustrated in FIG. 2(*b*), the plate-shaped workpiece 1 shown in FIG. 2(*a*) is placed between the press-forming surfaces of the upper die 10 and the lower die 11, and a press-forming operation is performed by pressing the upper die 10 against the lower die 11.

As illustrated in FIG. 2(*c*), due to the press-forming operation, the bottom portions 2 and 3 are formed at substantially the central part of the workpiece 1 in the width direction, the left side wall portions 4 and 5 are formed on a side of the bottom portion 2 in the width direction, the right side wall portion 6 is formed on a side of the bottom portion 3 in the width direction, the flange portion 8 is formed at an end of the left side wall portion 5 in the width direction, and the flange portion 7 (which has the hemming prongs 9) is formed at an end of the right side wall portion 6 in the width direction. Bend lines B1 to B6 extending in the longitudinal direction are formed along boundaries between the portions 2 to 8. At each of the bend lines B1 to B6, a bend-facilitating line G extending in the longitudinal direction is formed at a position corresponding to a bent line in the final closed-sectional shape.

Second Step

Next, as illustrated in FIG. 3, by clamping the bottom portions 2 and 3 of the workpiece 1, which has been press-formed as described above, between the first punch 15 and the pad 16, the workpiece 1 is bent along the bend line B4 in such a direction that the left side wall portions 4 and 5 and the right side wall portion 6 approach each other.

Third Step

Next, as illustrated in FIGS. 5(*b*) and 6(*b*), the hydraulic actuator 25 is operated to move the second punch 21 downwardly. In accordance with the operation of the hydraulic actuator 25, the cam driving mechanisms 26 move the pair of pressure cams 23 and 24 from the standby positions toward the pressing surfaces. Thus, the left side wall portion 5 and the right side wall portion 6 of the workpiece 1, which are pressed by the pressing surfaces of the pair of pressure cams 23 and 24, approach each other.

As illustrated in FIGS. 5(*c*) and 6(*c*), the pair of flange portions 7 and 8 become closed when the pair of pressure cams 23 and 24 are moved to the pressing positions by the cam driving mechanism 26.

As illustrated in FIG. 6(*c*), when the hydraulic actuator 25 is operated to lower the second punch 21, each of the depressing portions 31 enters a space between the pair of pressure cams 23 and 24, and the pair of flange portions 7 and 8 are depressed by coming into contact with the protrusions 32 of the depressing portions 31.

Thus, the bottom portions 2 and 3, the left side wall portions 4 and 5, and the right side wall portion 6 are bent along the bend lines B2 to B5 to have predetermined three-dimensionally curved shapes.

At the same time, as illustrated in FIG. 5(*c*), when the second punch 21 is lowered, the hemming portions 30 join the flange portion 7 to the flange portion 8 via the plurality of hemming prongs 9.

Figure 7A:
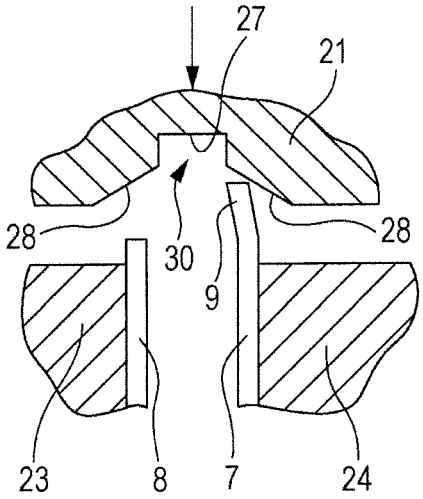
FIGS. 7(*a*)-(*b*) illustrate the details of the hemming operation performed in the third step.
Figure 7B:
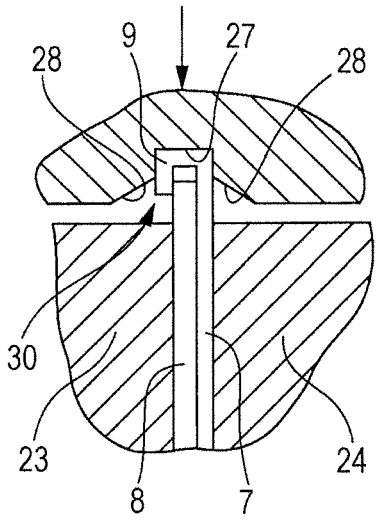

In other words, as illustrated in FIG. 7(*a*), when each of the plurality of hemming prongs 9 formed along an edge of the flange portion 7, contacts one of the insert guide surfaces 28 of a corresponding one of the hemming portions 30, an end of the hemming prong 9 becomes deformed toward the slit clearance 27. Then, as illustrated in FIG. 7(*b*), as the second punch 21 lowers, a downward pressing force is applied from the inner surface of the slit clearance 27 to each of the hemming prongs 9. Therefore, the hemming prongs 9 are bent downwardly along lines near the boundaries between the flange portion 7 and the hemming prongs 9, and the hemming prongs 9 clamp end portion of the flange portion 8. Thus, the flange portion 7 is joined (joined by hemming joint) to the flange portion 8 via the plurality of hemming prongs 9. The step of forming a hemming joint shown in FIG. 5(*c*) may be performed simultaneously with the bending step shown in FIG. 6(*c*), or may be performed after the bending step shown in FIG. 6(*c*) has been finished (after pressing has been finished) by adjusting the shape of the blank and the shape of the die. The hemming portions may also welded, for example, as necessary.

Operational Effects

As described above, the first step is performed to form respective bend lines extending in the longitudinal direction B2 to B5 at least along boundaries between the bottom portions 2 and 3 and the left and right side wall portions 4, 5, and 6 of the plate-shaped workpiece 1.

Next, the second step is performed to bend the bend line B4 in a direction that the left side wall portions 4 and 5 and the right side wall portion 6 approach each other.

Subsequently, the third step is performed to push the pair of pressure cams 23 and 24 inwardly, while the bottom portions 2 and 3 of the workpiece 1 is placed on the pad 16, to move the left side wall portions 4 and 5 and the right side wall portion 6 closer to each other so that the pair of flange portions 7 and 8 are butted against each other and to define a die cavity having the same shape as the final closed cross-sectional shape with the support surface of the pad 16 supporting the bottom portions 2 and 3 and the pressing surfaces of the pair of pressure cams 23 and 24 pressing the left and right side wall portions 4, 5, and 6. The third step is further performed to press the bottom portions 2 and 3, the left side wall portions 4 and 5, and the right side wall portion 6 against the support surface (the pad 16) and the pressing surfaces (the pair of pressure cams 23 and 24) that form the die cavity by depressing the pair of flange portions 7 and 8 toward the cavity using the depressing portions 31 of the second punch 21.

As a result, the bottom portions 2 and 3 and the left and right side wall portions 4, 5, and 6 of the closed cross-sectional structure can be easily formed with high precision.

Thus, by using our forming method, an integrally formed part in which a flange is minimized for weight reduction and which is used in the fields of automobile industry, home electronics industry, and other fields, can be easily manufactured. Moreover, a part having a curved surface on a side thereof can be formed with high precision.

Note that the method, which is a method of forming the plate-shaped workpiece 1 into a closed cross-sectional structure, can be used not only to form the closed cross-sectional structure described above but also to form various other closed cross-sectional structures.

Example

A closed cross-sectional structure was formed by performing the first to third steps on a 980 MPa grade cold-rolled steel sheet (plate thickness: 1.6 mm, tensile strength: 1005 MPa, yield strength: 680 MPa, total elongation: 17% (measured for a JIS No. 5 test piece in a direction perpendicular to the rolling direction in accordance with JIS Z 2241) (our example). In addition, the first to third steps were performed by using a die in which the depressing portion was not formed, as an example of a die in which only the structure of the second punch was changed (comparative example). As a result, in our example, the forming operations in all of the first to third steps could be performed with high precision, and error in dimensions of a part obtained after performing the third step (deviation from the dimensions of the dies) was as small as ±0.4 mm. In the comparative example, the forming operations in the first step and the second step could be performed, but the forming operation in the third step could not be performed and the shape of the round bent portion could not be formed because of an insufficient depression.

The invention claimed is:

1. A method of forming a plate-shaped workpiece into a closed cross-sectional structure, the structure including a bottom portion formed in a central part thereof in a width direction and extends in a longitudinal direction, left and right side wall portions located on both sides of the bottom portion in the width direction and rise in a height direction, and a pair of flange portions formed at ends of the left and right side wall portions in the height direction, comprising:

a first step of press-forming the plate-shaped workpiece into a shape having first bend lines that extend in a longitudinal direction and portions that are separated by the first bend lines to correspond to the bottom portion, the left and right side wall portions, and the pair of flange portions such that the portion corresponding to the bottom portion includes a first bottom portion and a second bottom portion that incline in the height direction toward a second bend line that extends in the longitudinal direction along a boundary between the first and second bottom portions;

a second step of bending the workpiece, which has been formed in the first step so that the portions corresponding to the left and right side wall portions face each other by clamping the portion corresponding to the first and second bottom portions between a first punch and a pad having a support surface in a plate-thickness direction to bend the plate-shaped workpiece along the second bend line to cause the first and second bottom portions to reverse the direction of the incline of the first and second bottom portions to incline in a direction opposite to the height direction toward the second bend line; and a third step of:

pushing a pair of pressure cams having respective pressing surfaces inwardly, while the portion of the workpiece corresponding to the bottom portion formed in the second step is placed on the support surface of the pad, to move the portions corresponding to the left and right side wall portions closer to each other so that the portions corresponding to the pair of flange portions are butted against each other and to define a die cavity having the same shape as a final shape of the closed cross-sectional structure with the support surface of the pad and the pressing surfaces of the pair of pressure cams; and pressing the portions corresponding to the bottom portion and the left and right side wall portions against the support surface and the pressing surfaces that form the die cavity by further bending the workpiece at the first bend lines to depress the portions corresponding to the pair of flange portions toward the cavity using a depressing portion of a second punch disposed above the pair of flange portions.

2. The method according to claim 1, wherein the final shape of the closed cross-sectional structure is a shape in which the bottom portion and the left and right side wall portions have curvatures in the longitudinal direction, and the first step press-forms the plate-shaped workpiece into the shape that the portions corresponding to the bottom portion and the left and right side wall portions have curvatures in the longitudinal direction.

3. An apparatus that forms a plate-shaped workpiece into a closed cross-sectional structure, the structure including a bottom portion formed in a central part thereof in a width direction and extends in a longitudinal direction, left and right side wall portions located on both sides of the bottom portion in the width direction and rise in a height direction, and a pair of flange portions formed at ends of the left and right side wall portions in the height direction, comprising:

a pressing die including an upper die and a lower die that press-forms the plate-shaped workpiece into a shape having first bend lines that extend in a longitudinal direction and portions that are separated by the first bend lines to correspond to the bottom portion, the left and right side wall portions, and the pair of flange portions such that the portion corresponding to the bottom portion includes a first bottom portion and a second bottom portion that incline in the height direction toward a second bend line extending in the longitudinal direction along a boundary between the first and second bottom portions;

a bending die that bends the workpiece, which has been formed using the pressing die so that the portions corresponding to the left and right side wall portions face each other by clamping the portion corresponding to the first and second bottom portions between a first punch and a pad having a support surface in a plate-thickness direction to bend the plate-shaped workpiece along the second bend line to cause the first and second bottom portions to reverse the direction of the incline of the first and second bottom portions to incline in a direction opposite to the height direction toward the second bend line; and a final-closed-cross-section bending die including a pair of pressure cams having respective pressing surfaces that move the portions corresponding to the left and right side wall portions closer to each other and a second punch disposed above the portions corresponding to the pair of flange portions, the second punch including a depressing portion that depresses the portions corresponding to the pair of flange portions that are butted against each other, the final-closed-cross-section bending die defining a die cavity having the same shape as a final shape of the closed cross-sectional structure with the support surface of the pad and the pressing surfaces of the pair of pressure cams, the depressing portion of the second punch pressing the portions corresponding to the bottom portion and the left and right side wall portions against the support surface and the pressing surfaces by further bending the workpiece at the first bend lines to depress the portions corresponding to the pair of flange portions that are butted against each other toward the cavity.

* * * * *